US006127013A

United States Patent [19]

Todd

[11] Patent Number: 6,127,013

[45] Date of Patent: Oct. 3, 2000

[54] SYSTEM AND DEVICE FOR IDENTIFYING CHARACTERISTICS OF OBJECTS

[76] Inventor: Andrea Todd, 2968 Hartline, Rochester Hills, Mich. 48309

[21] Appl. No.: 09/098,610

[22] Filed: Jun. 17, 1998

[51] Int. Cl.[7] ..... B42F 21/00

[52] U.S. Cl. ..... 428/40.1; 283/40; 283/41; 283/42; 283/43; 283/81; 428/42.1; 428/42.2; 428/42.3

[58] Field of Search ..... 428/40.1, 42.1, 428/42.2, 42.3; 283/81, 40, 41, 42, 43

[56] References Cited

U.S. PATENT DOCUMENTS

| | | | |
|---|---|---|---|
| 4,978,143 | 12/1990 | Ericson | 283/38 |
| 5,227,209 | 7/1993 | Garland | 428/40.1 |
| 5,254,381 | 10/1993 | Hoffmann et al. | 428/40.1 |
| 5,343,647 | 9/1994 | Bulka | 40/630 |
| 5,351,426 | 10/1994 | Voy et al. | 40/638 |
| 5,462,783 | 10/1995 | Esselman | 428/40.1 |

*Primary Examiner*—Nasser Ahmad

*Attorney, Agent, or Firm*—Michael I. Kroll

[57] ABSTRACT

A system for identifying characteristics of objects on which they are positioned and tracking the identified objects when sold. The system includes a master tracking sheet and a plurality of identification sheets. Each of the identification sheets includes a plurality of removable self adhesive labels positioned therein. Each label has indicia identifying a particular characteristic of a respective one of the objects printed thereon and a code separating the labels into groups. Each group identifies an owner of the objects on which the labels of that group are adhered. The master tracking sheet includes a plurality of columns, each column being associated with a respective group of labels. The indicia relates to at least one of price, condition, inventory codes and conditions for sale of the object on which the labels are adhered. When an object is sold, the monetary value on a label adhered thereto is inserted in the correct column on the tracking sheet. When the tracking sheet is filled, the columns are totaled. The total in each column indicates a respective amount of moneys earned by the owner associated with the respective column.

7 Claims, 11 Drawing Sheets

SYSTEM AND DEVICE FOR IDENTIFYING CHARACTERISTICS OF OBJECTS

BACKGROUND OF THE INVENTION

1. Field of the Invention

The present invention relates generally to labels for identifying and providing characteristic information about an object to which it is adhered and, more specifically, to a coded labeling system consisting of a plurality of label sheets, each sheet including a plurality of columns and each column including a plurality of removable self adhesive labels having indicia printed thereon. The indicia printed on each self adhesive label is used to identify a particular characteristic associated with an object on which it is to be adhered.

2. Description of the Prior Art

Numerous types of devices for identifying an object have been provided in prior art. For example, U.S. Pat. Nos. 5,227,209; 5,254,381; 5,343,647; 5,351,426; 5,462,783 and 5,535,536 all are illustrative of such prior art. While these units may be suitable for the particular purpose to which they address, they would not be as suitable for the purposes of the present invention as heretofore described.

U.S. Pat. No. 5,227,209

Inventor: Dean Garland

Issued: Jul. 13, 1993

An array of separable decals are provided to address the difficult problem of working with very tiny or narrow decals with the fingers of the human hand. The decal array is comprised of a longitudinally extending printed laminar paper strip having an upper exposed surface and an opposite surface coated with pressure sensitive adhesive. A laminar backing sheet coated with a release agent is disposed in contact throughout with the adhesive coated side of the printed strip. Transversely extending indicia, such as identification information, are printed on the exposed surface of the printed strip at longitudinal intervals therealong. The printed strip is transversely scored above each of the transversely extended indicia. Both the printed strip and the backing sheet beneath are transversely scored below each of the transversely extending indicia. The scoring is such that the printed strip separates more readily at the scoring above the transverse indicia than at the scoring below it. In this way, a decal bearing a single indicia may be detached from the array by means of a handling tab which may be separated from the decal once the decal has been affixed to the desired support.

U.S. Pat. No. 5,254,381

Inventor: Donald J. Hoffmann et al.

Issued: Oct. 19, 1993

A method of making a label-equipped sheet and product in which an elongated release liner has one face thereof equipped with pressure sensitive adhesive and adhered to one surface of a base stock web, the base stock web being die cut in a closed perimeter within the confines of the release liner, the die cutting including a generally linear segment, which is adjacent an area of the release liner free of release material, to provide a longitudinally-extending liner band adhesively secured to the web.

U.S. Pat. No. 5,343,647

Inventor: Tricia Bulka

Issued: Sep. 6, 1994

A versatile paperboard panel can be used to attach identifying (e.g. price) information to a wide variety of articles.

A release coating is applied to a first face of the panel, and a label having an adhesive face is disposed over the panel with the adhesive in contact with the release coating. A perforation allows separation of the panel into first and second portions. The first portion contains the label, and the second portion includes an opening capable of receiving an attachment mechanism (such as a hook or string). A number of panels may be provided in a cut or continuous sheet that may be fed through a printer, the sheet having a first layer of paperboard which forms the panels, and a second layer of paper which forms the labels, with adhesive attached to the paper and a release coat to the panel. The labels are die cut from the second layer, and the panels are die cut from the first layer. Tractor holes may be provided along edges of the sheet to facilitate feeding through a printer, which prints the identifying indicia on the labels. The panels may be used by placing an attachment mechanism connected to the article into association with the panel second portion opening, or removing the label from the panel and applying it to the article, or separating the panel along the perforation and attaching the first portion of the panel (with the label still attached) to the article (e.g. by sliding it into a channel).

U.S. Pat. No. 5,351,426

Inventor: Peter A. Voy et al.

Issued: Oct. 4, 1994

A label assembly improving the releasability of individual labels from a carrier sheet. The labels are spaced along the length of the carrier sheet in a longitudinal direction. An adhesive temporarily retains the labels on the carrier sheet. A transverse leading edge of each label is adhesive-free. Benefits include a) reduced adhesion of the labels to the carrier sheet during die-cutting of the labels and b) improved releasability of the labels from the carrier sheet during label application.

U.S. Pat. No. 5,462,783

Inventor: Dennis Esselmann

Issued: Oct. 31, 1995

A label dispensing sheet for incorporation within a book such as a telephone directory, dictionary or the like, includes a facing sheet of heavy paper stock releasably secured to a relatively thin backing sheet or liner by a pressure sensitive adhesive and containing a series of indicia bearing labels or tabs adapted to be applied to the pages of the book to designate the various alphabetical headings, sub headings, categories or divisions thereof. The facing sheet and the liner have overlying, extended edges for binding the label dispensing sheet proper within the book with corresponding portions of these extended edges being die cut and perforated, respectively, to form a lock and release construction holding the sheet securely in place in the book, while permitting its ready removal therefrom during tab assembly to the book pages. The labels have extended right and left halves for adhesively contacting opposite sides of the book pages and separated one from another by a scored center or crack line to insure ready, accurate folding of the labels during assembly to the book pages. The labels have edge markings such as dashes for aligning the labels with the edges of the book pages during assembly thereto, to insure the labels have a uniform projection therefrom for ease of visibility and to present an extension suitable for gripping contact by the book user in turning to a desired section of the book.

U.S. Pat. No. 5,535,536

Inventor: Tyler K. Comann

Issued: Jul. 16, 1996

A system for allowing a user of a commodity such as wine to easily remember the source, name and year of the commodity is provided which includes a removable label applied to the commodity, the label being removable and capable of being placed on a memorandum of the transaction by which the user acquired the commodity such as a sales slip. The label can be attached to the commodity with re-usable glue or alternatively with VELCRO, or some other appropriate material.

SUMMARY OF THE INVENTION

The present invention relates generally to labels for identifying and providing characteristic information about an object to which it is adhered and, more specifically, to a coded labeling system consisting of a plurality of label sheets, each sheet including a plurality of columns and each column including a plurality of removable self adhesive labels having indicia printed thereon. The indicia printed on each self adhesive label is used to identify a particular characteristic associated with an object on which it is to be adhered.

A primary object of the present invention is to provide a system and device for identifying characteristics of objects that will overcome the shortcomings of the prior art devices.

Another object of the present invention is to provide a system and device for identifying characteristics of objects including a plurality of sheets filled with a plurality of columns, each column including a plurality of removable self adhesive labels whereby characterizing indicia is printed on each label for identifying a particular characteristic associated with the object on which it is adhered.

An additional object of the present invention is to provide a system and device for identifying characteristics of objects wherein the indicia printed on each label relates to a physical quality of the object to which it will be adhered.

A further object of the present invention is to provide a system and device for identifying characteristics of objects wherein the indicia printed on each label is a generic term and wherein each label is matched with an object having qualities representative of the generic term printed thereon prior to being adhered to the object.

A still further object of the present invention is to provide a system and device for identifying characteristics of objects wherein the indicia printed on each label relates to a monetary value associated with the object to which it will be adhered.

An even further object of the present invention is to provide a system and device for identifying characteristics of objects wherein the indicia printed on each label relates to a condition for the sale of the object to which it will be adhered.

An additional object of the present invention is to provide a system and device for identifying characteristics of objects wherein each column of labels is printed in a different color, each different color being representative of a further characteristic of the object on which it is to be adhered.

An additional object of the present invention is to provide a system and device for identifying characteristics of objects wherein the color of each label adhered to an object identifies the owner of the object.

A further object of the present invention is to provide a system and device for identifying characteristics of objects that is simple and easy to use.

A still further object of the present invention is to provide a system and device for identifying characteristics of objects that is economical in cost to manufacture.

Further objects of the invention will appear as the description proceeds.

A system for identifying characteristics of objects on which they are positioned and tracking the identified objects when sold is disclosed by the present invention. The system includes a master tracking sheet and a plurality of identification sheets. Each of the identification sheets includes a plurality of removable self adhesive labels positioned therein. Each label has indicia identifying a particular characteristic of a respective one of the objects printed thereon and a code separating the labels into groups. Each group identifies an individual owner of the objects on which the labels of that group are adhered. The master tracking sheet includes a plurality of columns, each column being associated with a respective group of labels. The indicia relates to at least one of price, condition, inventory codes and conditions for sale of the object on which the labels are adhered. When an object is sold, the monetary value on a label adhered thereto is inserted in the correct column on the tracking sheet. When the tracking sheet is filled, the columns are totaled. The total in each column indicates a respective amount of moneys earned by the owner associated with the respective column.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, and wherein.

DESCRIPTION OF THE REFERENCE NUMERALS

Figure 1:
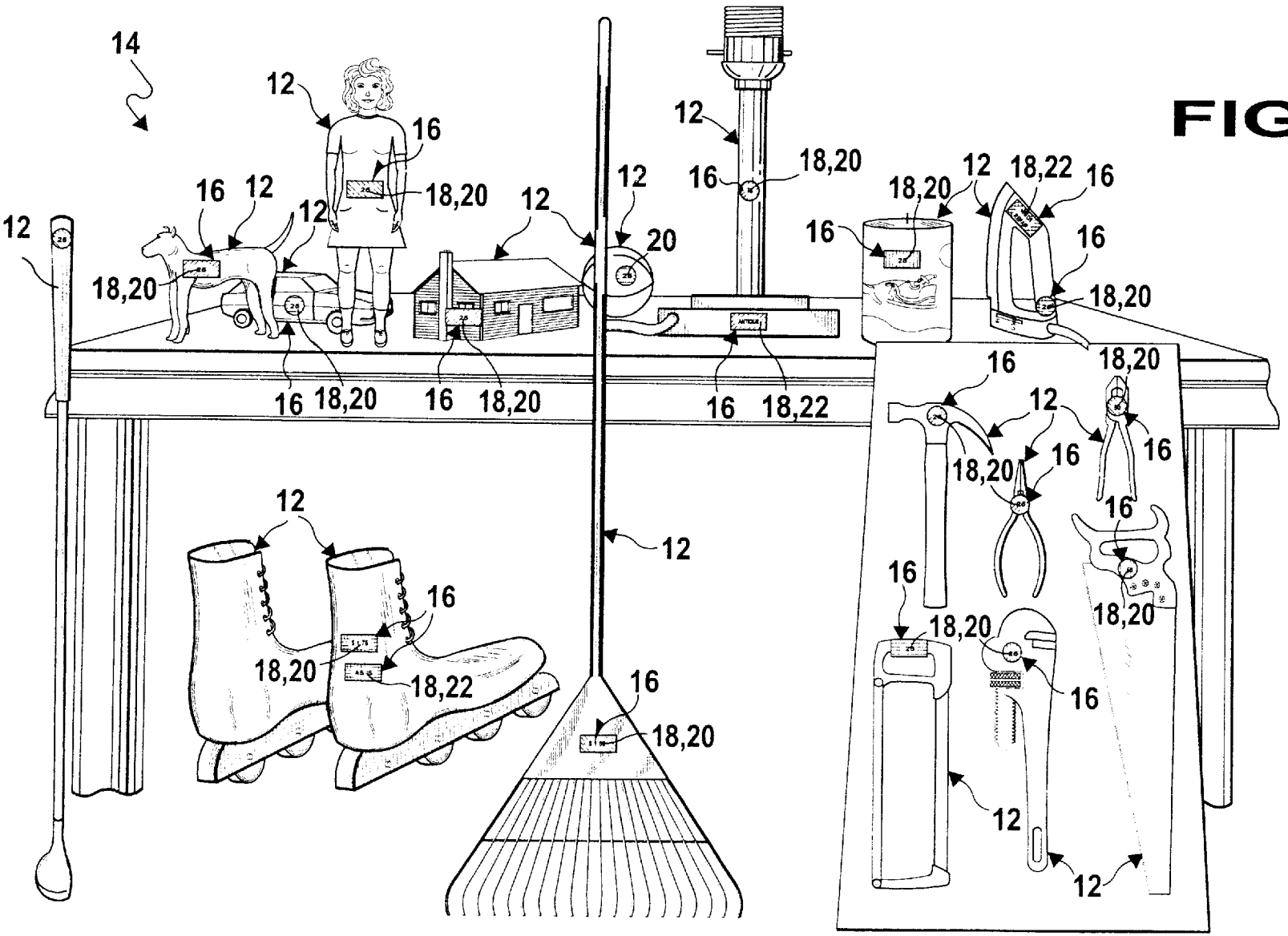
FIG. 1 is a perspective view of a plurality of items with color coded labels used with the system and device for identifying characteristics of objects of the present invention adhered thereto, each label being representative of a particular characteristics of the item to which it is adhered.

Turning now descriptively to the drawings, in which similar reference characters denote similar elements throughout the several views, FIGS. 1 through 10 illustrate the system and device for identifying characteristics of objects of the present invention. With regard to the reference numerals used, the following numbering is used throughout the various drawing figures.

10 system and device for identifying characteristics of objects

12 objects

14 area in which objects are positioned

16 removable self adhesive labels

18 indicia printed on labels

20 indicia indicating value or price

22 indicia indicating characteristic or condition for sale of item

24 master tracking sheet

26 sheet of individual labels

28 columns on master tracking sheet

30 spaces aligned to form columns on master tracking sheet

32 groups of color coated labels

34 top of master tracking list

35 first row on master tracking sheet

36 column heading spaces

38 bottom of column

40 space positioned at bottom of each column for insertion of total of items listed in respective column

42 space at base of master tracking sheet for notes

43 back side of labels

44 columns of label sheets

45 adhesive substance on back side of labels

46 face side of labels

48 lamp

50 first label on lamp

52 second label on lamp

54 pair of skates

56 first label on pair of skates

58 second label on pair of skates

60 iron

62 first label on iron

64 second label on iron

DETAILED DESCRIPTION OF THE PREFERRED EMBODIMENT

Turning now descriptively to the drawings, in which similar reference characters denote similar elements throughout the several views, FIGS. 1 through 10 illustrate the system and device for identifying characteristics of objects of the present invention indicated generally by the numeral 10.

The system and device for identifying characteristics of objects 10 is primarily used to identify particular characteristics associated with different objects. Such characteristics include monetary value, condition of the object, ownership or origin of the object, style and size of the object, conditions for sale of the object as well as other valuable information associated with the object and which may be of importance to a person buying, using or selling the object. Such a system is useful in instances in which a number of parties are pooling their possessions for selling such as in a garage sale, yard sale or tag sale. In such instances, the system 10 may be used to identify a price or value of each object, a condition of the object and the owner of the object. This would provide the persons involved in the sale with an easy method of identifying each object and thus simplify the division of moneys earned by the sale of the objects.

Use of the system and device for identifying characteristics of objects 10 in accordance with the present invention is illustrated in FIG. 1. This figure illustrates use of the system 10 for organizing a garage sale. A plurality of objects 12 are shown positioned about an area 14. Each object 12 includes at least one label 16 positioned thereon. The labels 16 illustrated include indicia 18 thereon. Such indica 18 includes printed matter indicating the monetary value of the object 20, i.e. the asking price of an object for sale, and in some instances the indicia 18 includes printed matter indicating a characteristic of the item or a condition for sale of the item 22. The plurality of labels 16 are also further used to identify the origin or owner of the object as they are coded according to either a color scheme or a plurality of cross hatching patterns. The coding of the labels 16 is indicated by the plurality of different cross-hatching patterns shown in the figure.

Figure 2A:
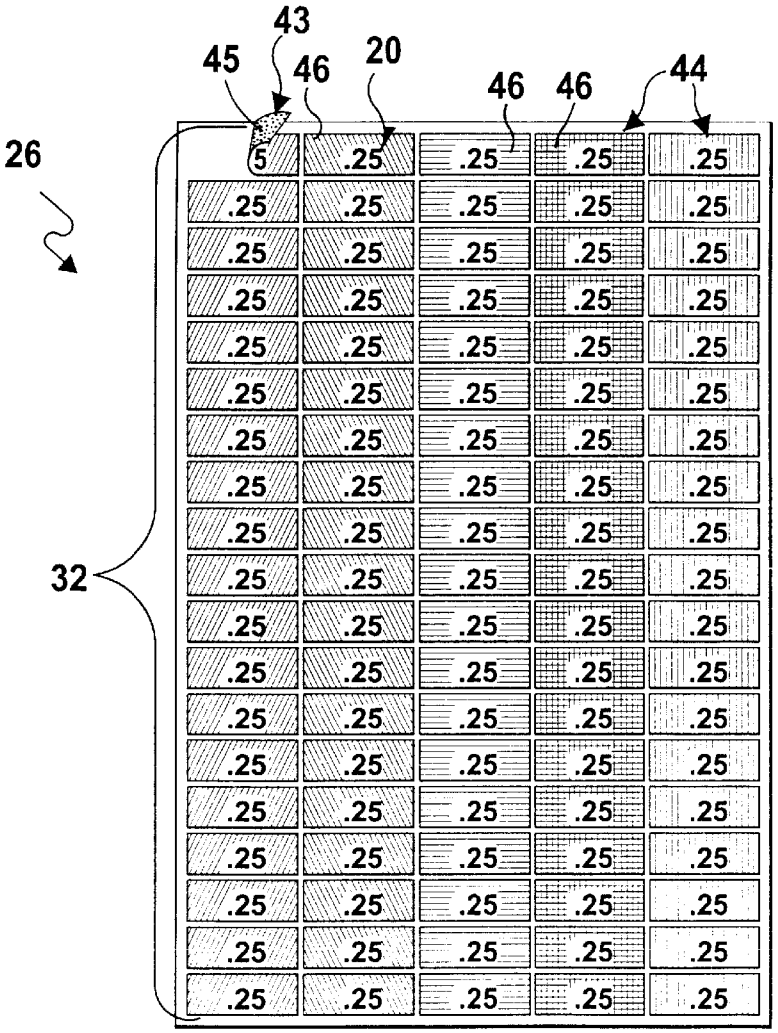
FIG. 2A is a front view of a color coded sheet including a plurality of removable self adhesive labels including a first example of identifying indicia printed thereon used with the system and device for identifying characteristics of objects of the present invention.
Figure 2:
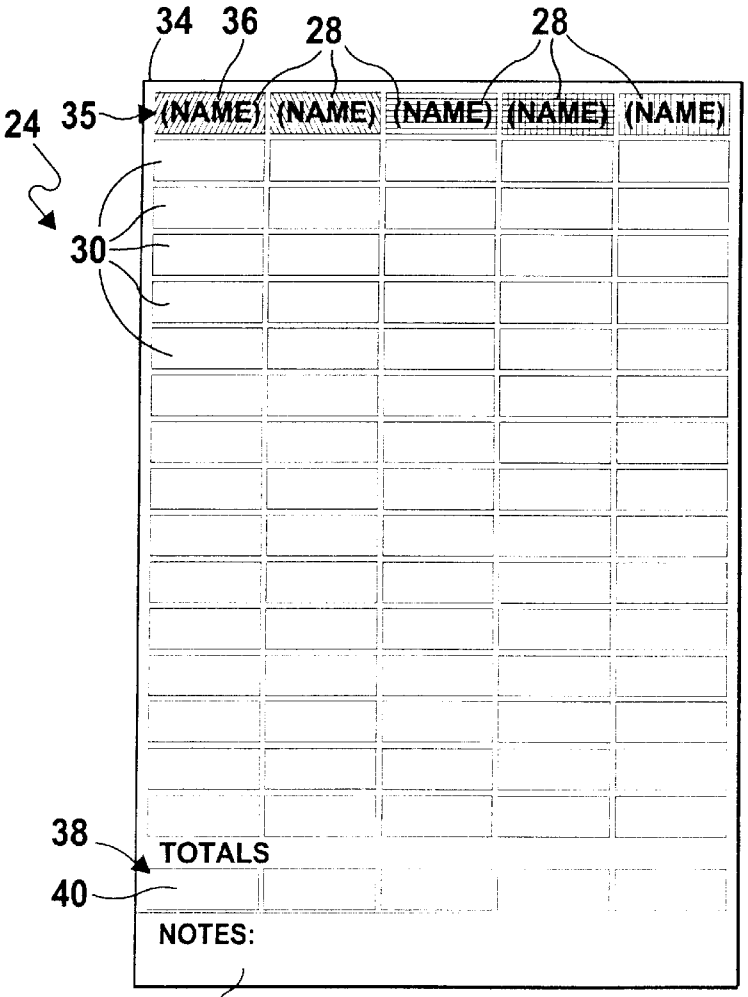
FIG. 2 is a front view of a master tracking sheet used with the system and device for identifying characteristics of objects of the present invention for tracking objects on which labels have been adhered.
Figure 2B:
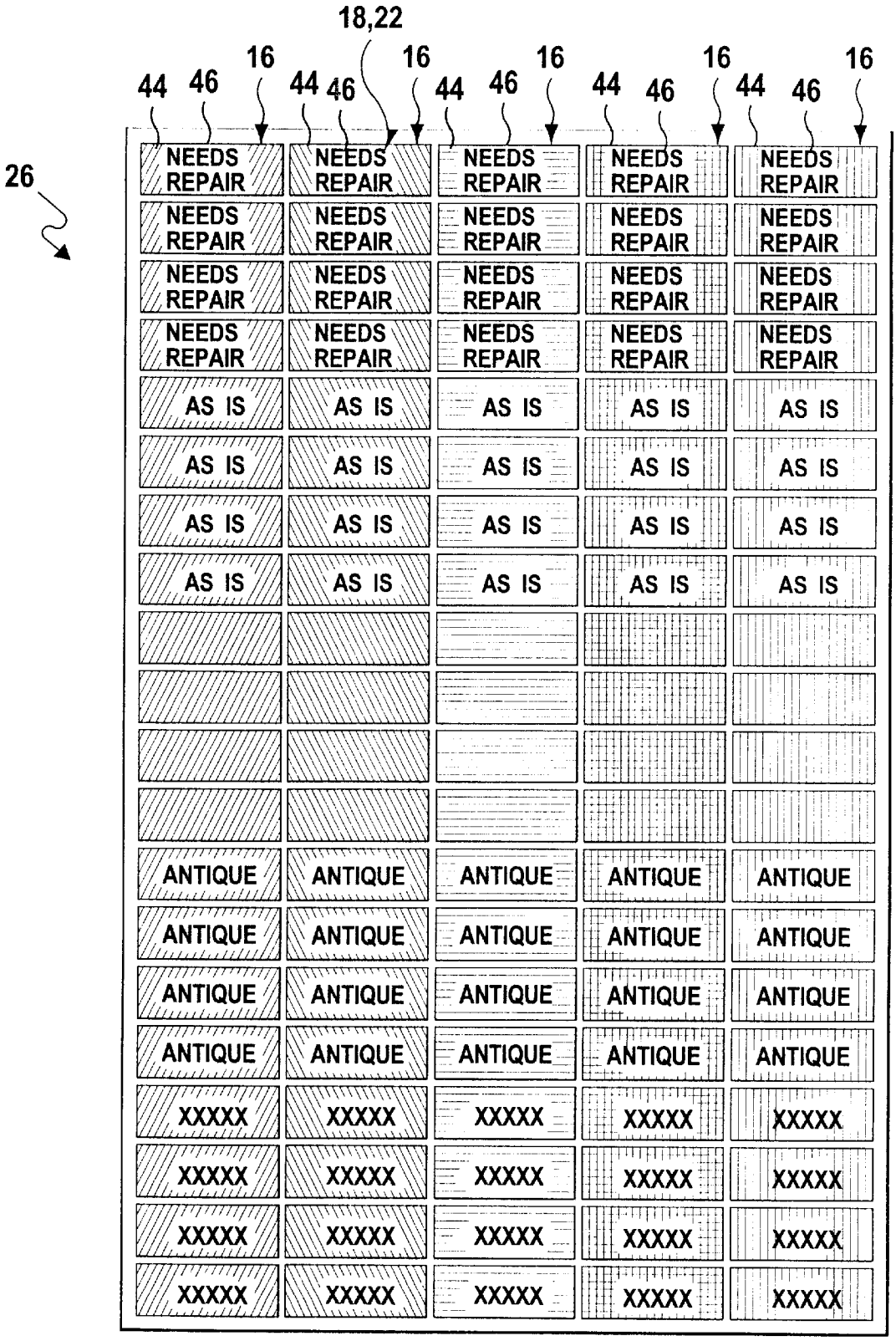
FIG. 2B is a front view of a color coded sheet including a plurality of self adhesive labels, each label including respective identifying indicia on a face side thereof, used with the system and device for identifying characteristics of objects of the present invention.

The system and device for identifying characteristics of objects 10 comprises a master tracking sheet 24 as illustrated in FIG. 2 and individual label sheets 26 as shown in FIGS. 2A and 2B. The master tracking sheet 24 is divided into columns 28, each column 28 being formed of a plurality of substantially identical spaces 30 in alignment. The labels 18 are divided into groups 32 based upon their individual coding pattern. Each column 28 on the master tracking sheet 24 represents a respective group 32 of labels 18.

At a top 34 of the master tracking sheet 24 and occupying a first row 35 thereon is a plurality of spaces 36 for insertion of column headings. Each space 36 represents the respective column 28 atop which it is positioned and are coded to represent a respective one of the groups 32 of labels 18. In a preferred usage, each group of coded labels 32 represents a different individual(s) owning property or a portion of the objects 12 to be sold and the individual(s) associated with a particular coded group 32 is identified in the respective space 36 corresponding to that group 32.

Aligned below the column heading spaces 36 are the plurality of spaces 30 for forming the respective columns 28. Each of the plurality of spaces 30 is preferably blank for entering information regarding items sold therein and thereby keeping track of objects sold, a price paid and the owner of the sold object. Each time an object 12 is sold the price paid should be entered in a blank space 30 positioned in the column 28 representing the owner of the object. Alternatively, the label 16 adhered to the object 12 and including indicia 20 indicating the value or price of the object 12 may be removed from the object 12 and positioned in the column 28 having a coded column heading 36 matching the coding of the label 16. At the bottom 38 of each column 28 is a space 40 for entering a total value of the entries positioned in the blank spaces 30 forming its respective column 28. This allows a total value of the moneys received to be tabulated and separated for each individual(s) represented by a column 28. A space 42 is also provided for entering any notes which may be needed to explain certain transactions or record other information which may be of use or interest to the parties involved.

Each label sheet 26 includes a number of columns 44 as illustrated in FIGS. 2A and 2B. Within each column 44 is a plurality of removably positioned self adhesive labels 16. Each of said removably positioned self adhesive labels 16 includes identifying indicia 18 located on a face side 46 thereof. The indicia illustrated in FIG. 2A relates to a value of an object on which it is to be adhered. Each label 16 illustrated in this figure includes identical indicia thereon. Each column of labels 16 is coded in a manner consistent with the column headings of the master tracking sheet 24. Each label 16 also includes a back side 43 on which an adhesive substance 45 is positioned for use in adhering the label 16 to an object.

The indicia printed on the label 16 illustrated in the figures is for purposes of example only and not meant to limit the present invention in any manner. Each label may include any desired indicia thereon and not only the illustrated and described herein. While preferred indicia for placement on the face side of the plurality of labels are shown and described herein, those of ordinary skill in the art who have read the description will appreciate that there are numerous other indicia which may be positioned on the labels for identifying other characteristics and, therefore, as used herein the phrase "means for use in identifying a characteristic of an object" should be construed as including all such devices as long as they achieve the desired result of identifying a characteristic of an object, and, therefore, that all such equivalent mechanisms and combinations are to be considered as equivalents to the ones described herein.

FIG. 2B also illustrates a label sheet 26 including a plurality of labels 16 aligned in coded columns 44. Each label 16 on this label sheet 26 includes indicia related to a specific characteristic printed on the face side 46 thereof. The labels 16 do not all include identical indicia printed thereon as is illustrated in FIG. 2A. A number of different characteristics are identified by the indicia 18 on the sheet 26. Certain labels on the sheet include indicia 16 related to a condition of an object, e.g. "NEEDS REPAIR" and "ANTIQUE", other labels include indicia related to a condition for sale of an object, e.g. "AS IS", further labels include indicia related to a code for an object such as is used for tracking inventory, e.g. "XXXX", while certain labels do not include indicia thereon and thus the user may provide any desired comment or characteristic information thereon. Each column of labels 16 is coded in a manner consistent with the column headings of the master tracking sheet 24.

The identifying indicia 18 relates to one of value 20, a condition 22, a coding number or a condition for sale of the object on which it is adhered. Each of the self adhesive labels 16 identify further distinguishing characteristics of the object on which they are adhered by including a particular coding such as a color scheme or a cross hatching pattern thereon. Adhesive labels including a particular coding thereon could represent origin or ownership of the object by a particular individual. Each individual owning objects identified by the system will be assigned labels 16 including a particular coding thereon for identification of the origin of the object.

Figure 3:
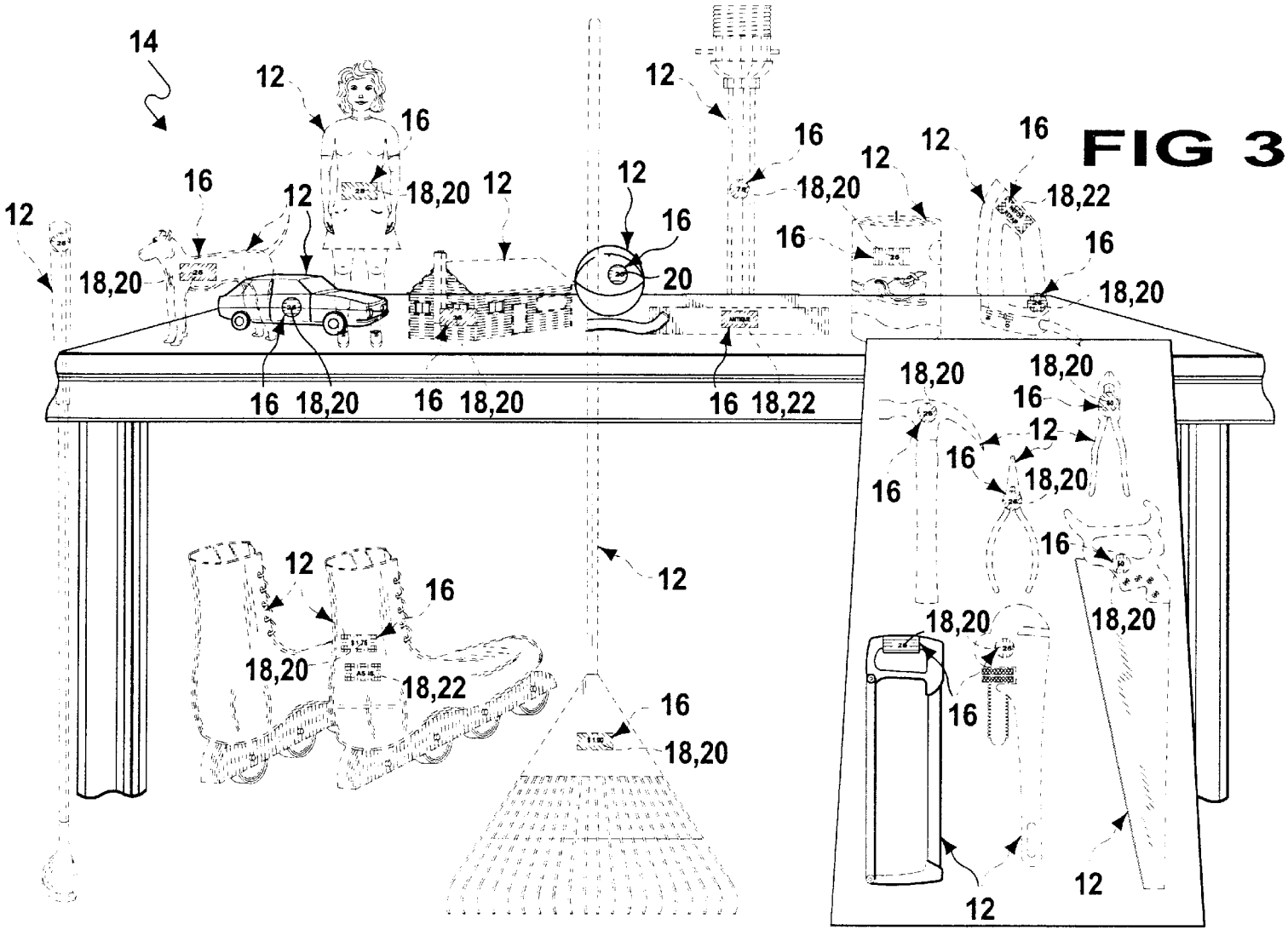
FIG. 3 is a perspective view similar to FIG. 1, of a plurality of items with coded labels used with the system and device for identifying characteristics of objects of the present invention adhered thereto for identifying particular characteristics of each item, items including a label(s) not related to a particular selected identified characteristic are illustrated in dashed lines.
Figure 4:
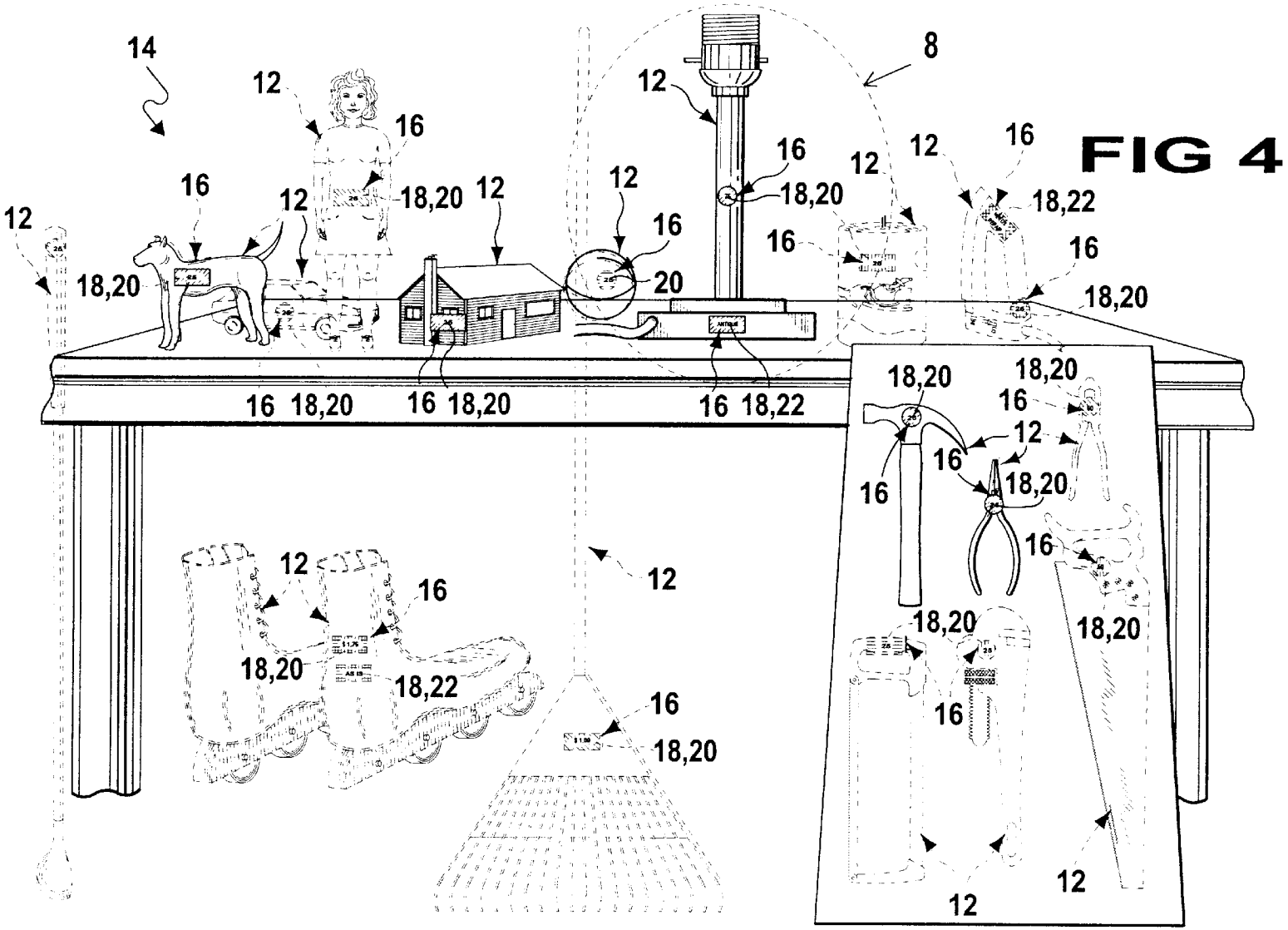
FIG. 4 is a perspective view similar to FIG. 1, of a plurality of items with the coded labels used with the system and device for identifying characteristics of objects of the present invention adhered thereto for identifying particular characteristics of each item, items including a label not related to a particular identified characteristic are illustrated in dashed lines.
Figure 5:
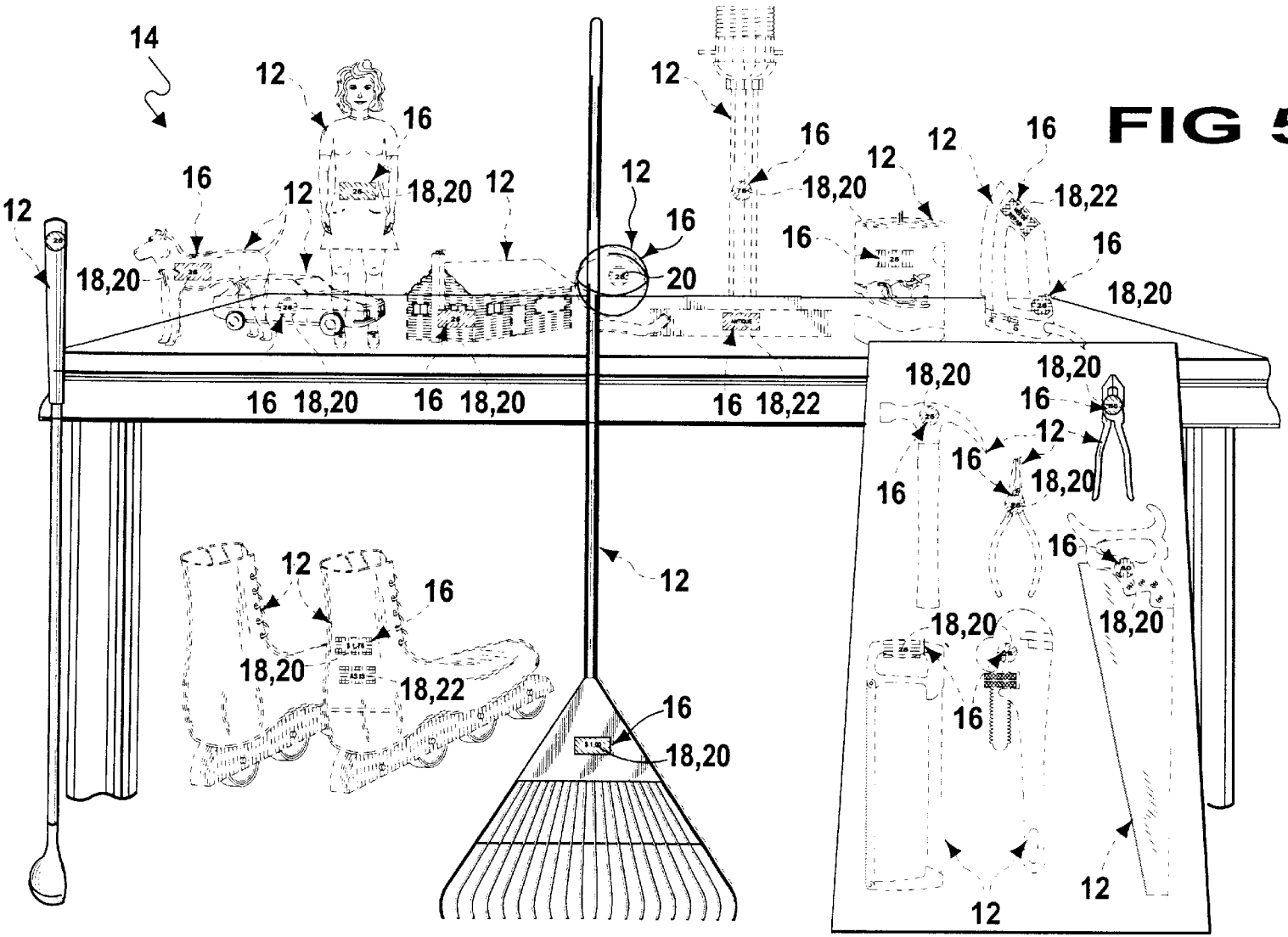
FIG. 5 is a perspective view similar to FIG. 1, of a plurality of items with the coded labels used with the system and device for identifying characteristics of objects of the present invention adhered thereto for identifying particular characteristics of each item, items including a label not related to a particular selected identified characteristic are illustrated in dashed lines.
Figure 6:
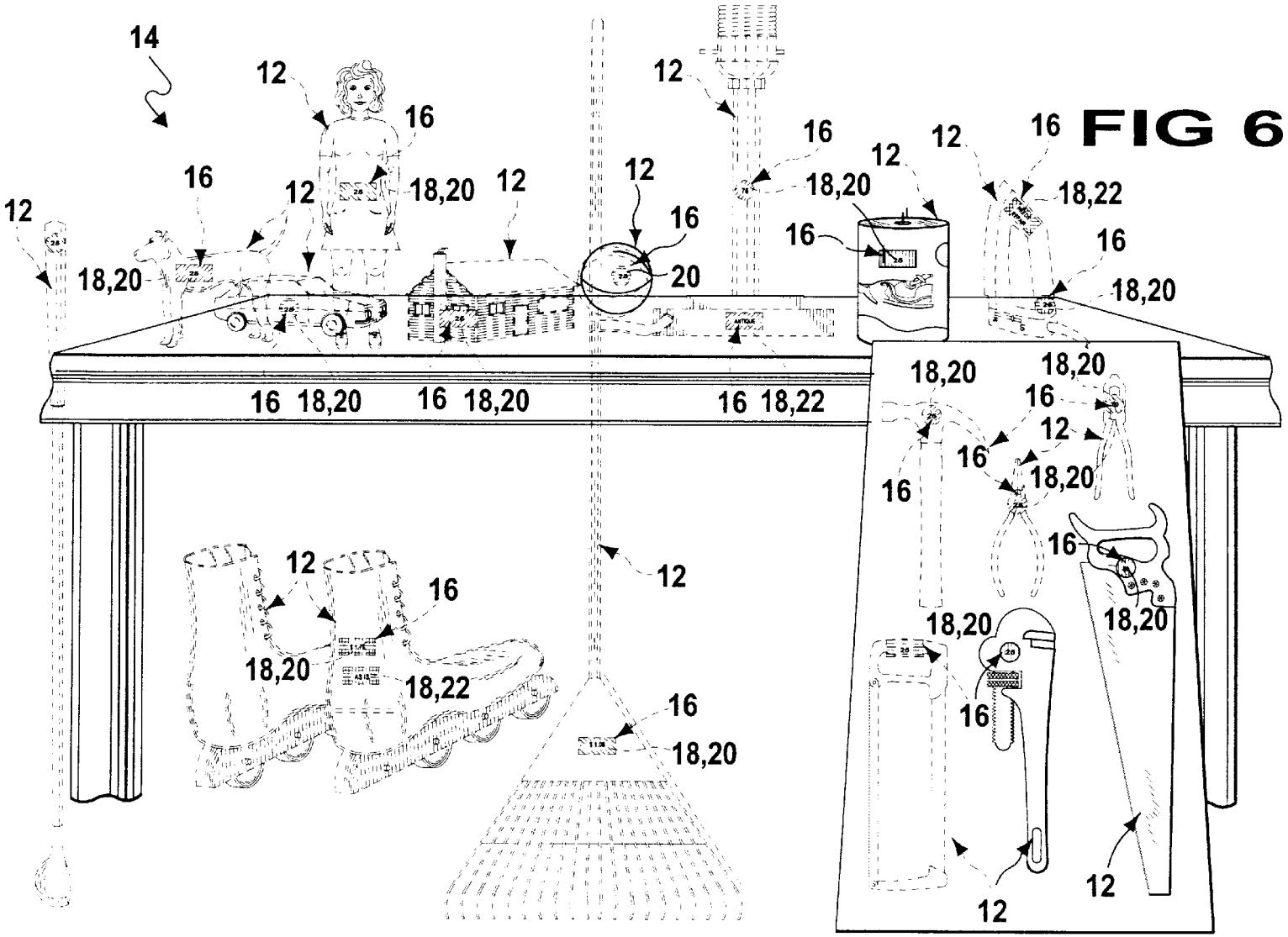
FIG. 6 is a perspective view similar to FIG. 1, of a plurality of items with the coded labels used with the system and device for identifying characteristics of objects of the present invention adhered thereto for identifying particular characteristics of each item, items including a label not related to a particular selected identified characteristic are illustrated in dashed lines.
Figure 7:
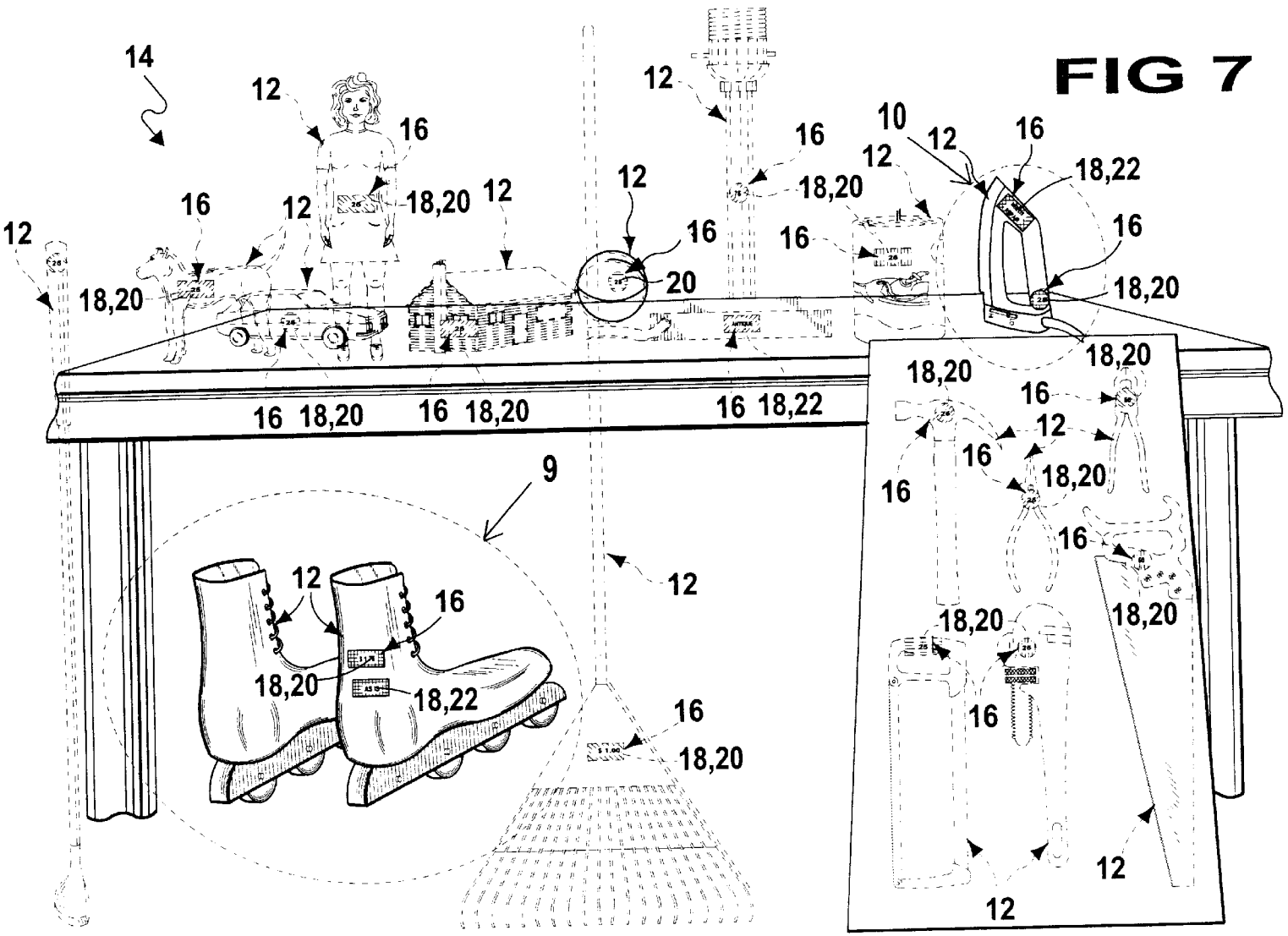
FIG. 7 is a perspective view similar to FIG. 1, of a plurality of items with the coded labels used with the system and device for identifying characteristics of objects of the present invention adhered thereto for identifying particular characteristics of each item, items including a label not related to a particular selected identified characteristic are illustrated in dashed lines.

FIGS. 3–7 each illustrate the objects for sale in a garage sale as illustrated in FIG. 1. In each of these figures all objects not including labels 16 having a desired color code or cross-hatching pattern thereon are illustrated in dashed lines. A desired color coding or cross-hatching is emphasized by each figure to illustrate how the color of the labels may be used to identify and group objects based upon a desired criteria such as ownership of the object. In FIG. 3, a hand saw, a basketball and a model of a car are selected, each having a label including a particular cross-hatching. In FIG. 4, a lamp, a hammer, a pair of needle nose pliers and a doll house are selected, each having a label including a particular cross-hatching. In FIG. 5, a rake and a wrench are selected, each having a label including a particular cross-hatching. In FIG. 6, a hand saw, a wrench and a roll of wallpaper are selected, each having a label including a particular cross-hatching. In FIG. 7, a pair of skates and an iron are selected, each having a label including a particular cross-hatching.

Figure 8:
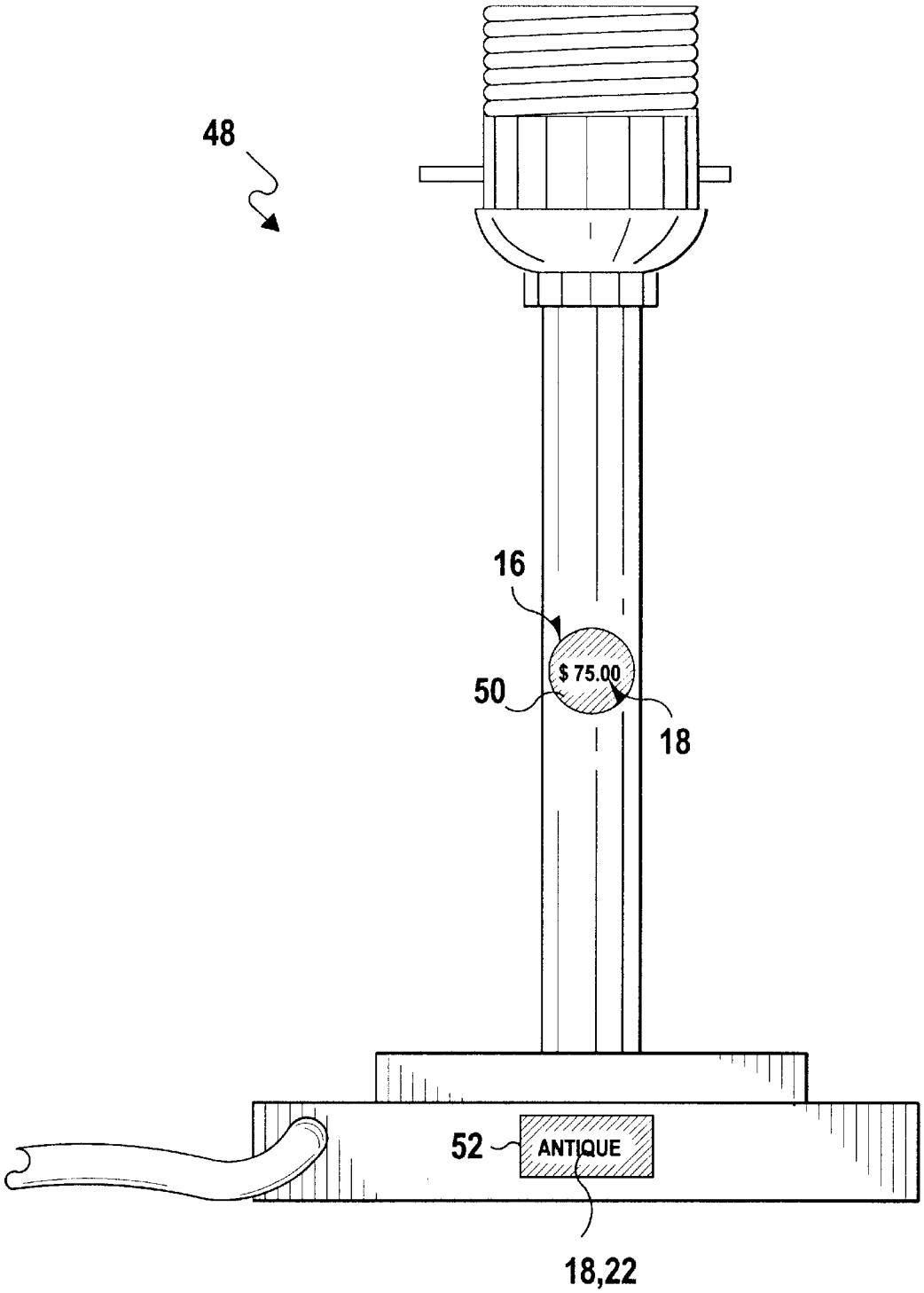
FIG. 8 is an enlarged view of a lamp including labels identifying particular characteristics of the lamp adhered thereto used with the system and device for identifying characteristics of objects of the present invention.

The lamp 48 illustrated in the circle labeled 8 of FIG. 4 is illustrated in FIG. 8. This figure illustrates two labels 16 positioned on the lamp for identifying individual characteristics of the lamp 48. A first label 50 identifies a value given to the lamp 48 and a second label 52 identifies a characteristic of the lamp 48, i.e. "ANTIQUE". Each label 16 is cross hatched in an identical manner to further identify an additional characteristic of the lamp 48 such as the owner of the lamp 48.

Figure 9:
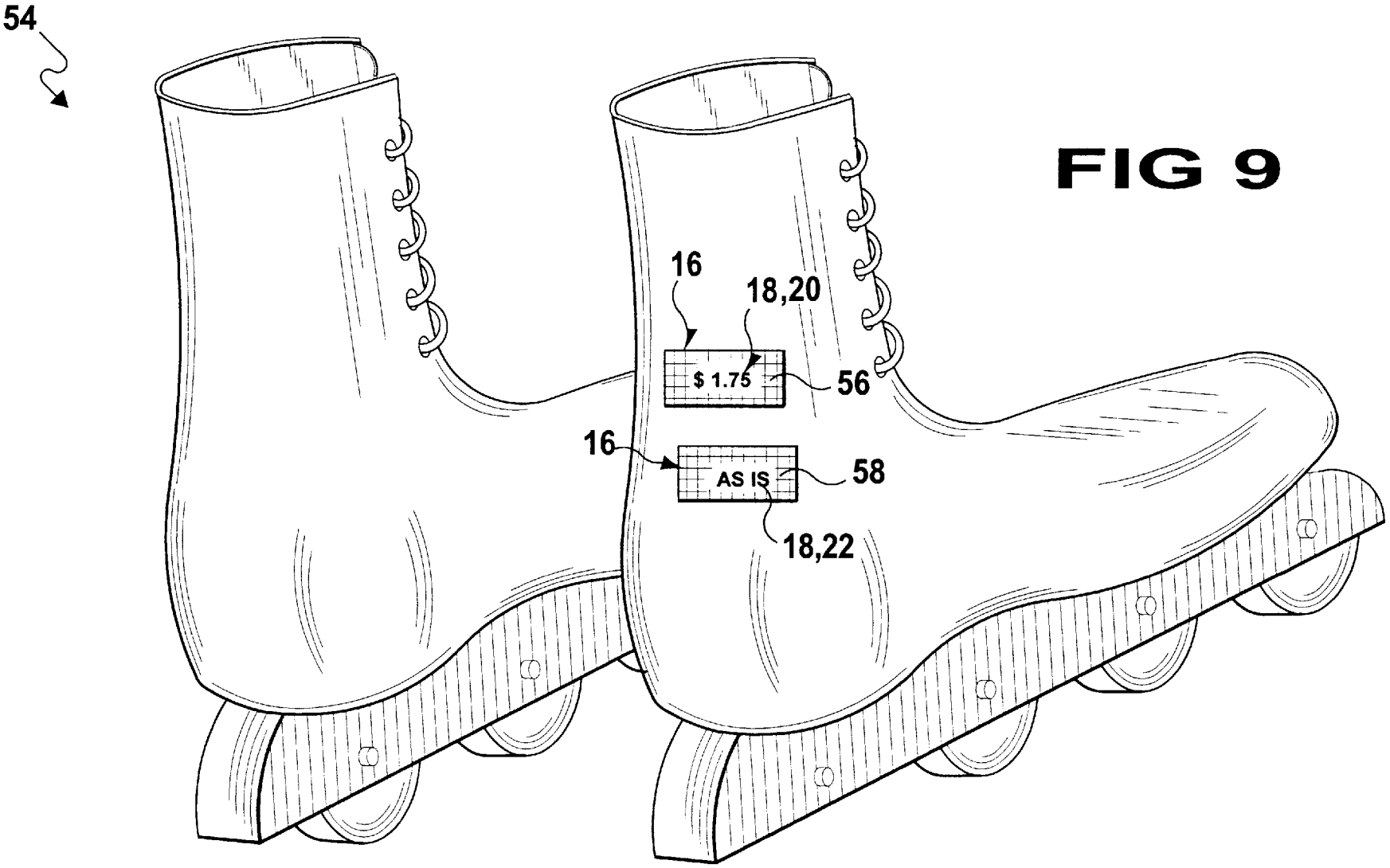
FIG. 9 is an enlarged view of a pair of skates including labels identifying particular characteristics of the pair of skates adhered thereto used with the system and device for identifying characteristics of objects of the present invention.

The pair of skates 54 illustrated in the circle labeled 9 of FIG. 7 is illustrated in FIG. 9. This figure illustrates two labels 16 positioned on the pair of skates 54 for identifying individual characteristics of the pair of skates 54. A first label 56 identifies a value given to the pair of skates 54 and a second label 58 identifies a condition for sale of the pair of skates 54, i.e. "AS IS". Each label 16 is cross hatched in an identical manner to further identify an additional characteristic of the pair of skates 54 such as the owner of the pair of skates 54.

Figure 10:
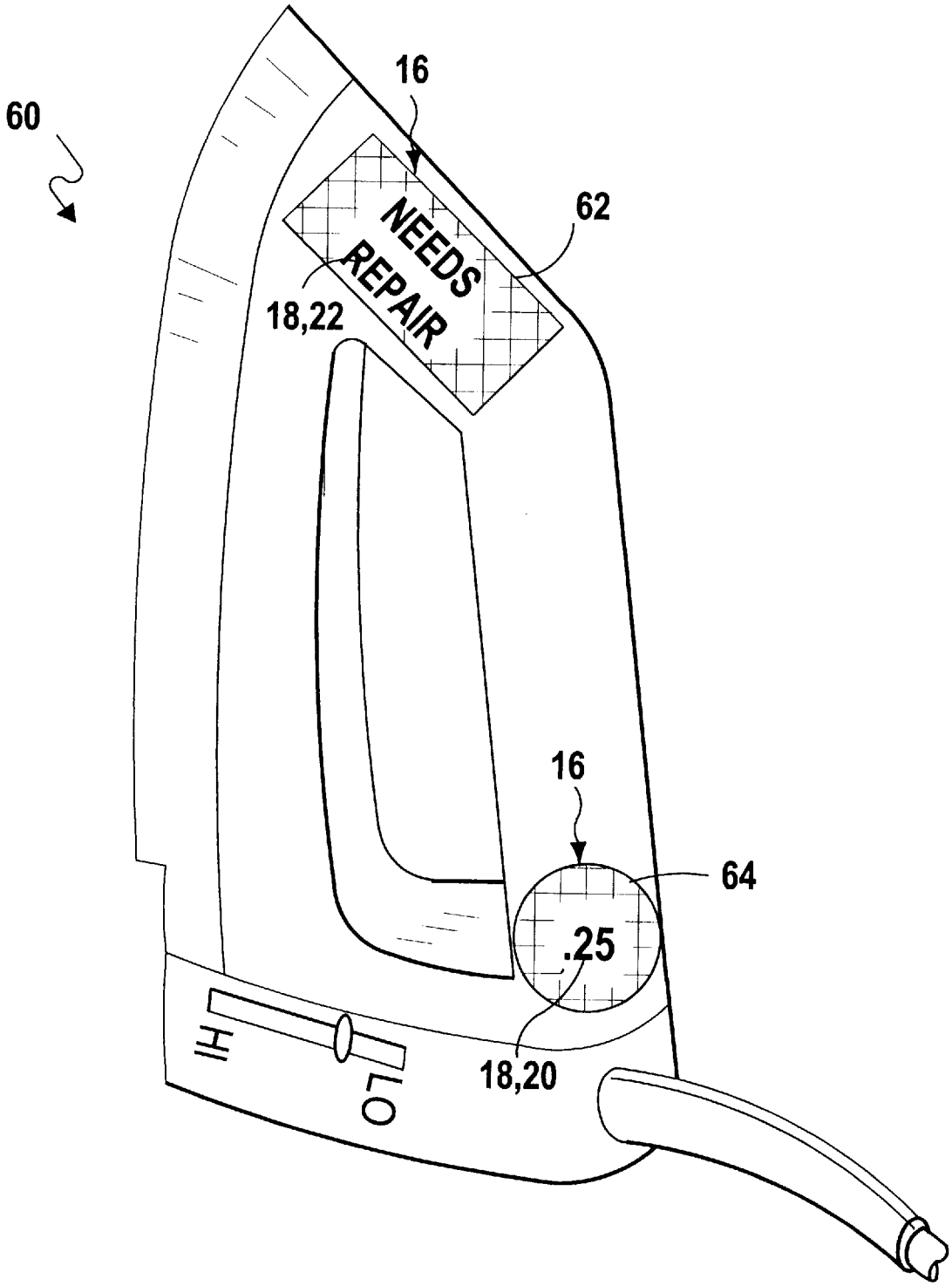
FIG. 10 is an enlarged view of an iron including labels identifying particular characteristics of the iron adhered thereto used with the system and device for identifying characteristics of objects of the present invention.

The iron 60 illustrated in the circle labeled 10 of FIG. 7 is illustrated in FIG. 10. This figure illustrates two labels 16 positioned on the iron 60 for identifying individual characteristics of the iron 60. A first label 62 identifies a value given to the iron 60 and a second label 64 identifies a condition of the iron 60, i.e. "NEEDS REPAIR". Each label 16 adhered to the iron 60 is cross hatched in an identical manner to further identify an additional characteristic of the iron 60 such as the owner of the iron 60.

Each label 16 can be of any desired shape such as rectangular, square, triangular, circular, etc. The labels can also be color coded or hatched in any desired manner The operation of the system and device for identifying characteristics of objects 10 will now be described with reference to the figures. In operation, the system and device for identifying characteristics of objects 10 is normally used for a sale when a number of individuals are pooling their items for sale. The description of use of the system will be directed to such a use but it is to be realized that use of the present invention is not limited to such use. The system of the present invention may be used in any similar fashion to identify characteristics associated with and track numerous objects.

Once the parties owning objects to be sold in the sale are identified, a particular code for identifying each party objects is chosen, i.e. each party is assigned a particular color label or particular cross hatching pattern printed on the labels. Each party is then identified in the appropriate column heading on the master tracking sheet.

Each party is then supplied with a sufficient number of labels including appropriate indicia for identifying a value and desired characteristics of each object. The labels are matched with and adhered to the appropriate objects. It is now time for the sale to begin.

As the sale progresses and objects are sold, an amount received for each particular object is entered in an appropriate space on the master sheet under the appropriate column heading. Alternatively, the label adhered to the sold object is removed from the object and re-adhered to an appropriate space on the master tracking sheet. As the sale progresses, the master tracking sheet will track each sale, the amount received for each sale and the owner of the particular objects sold.

When the sale is over the individual columns are added up and a total amount for each column is positioned at the space representing the column totals at the bottom of the master tracking sheet. Each total represents an amount earned by the particular individual or party represented by the respective column and thus an amount due that individual or party.

From the above description it can be seen that the system and device for identifying characteristics of objects of the present invention is able to overcome the shortcomings of prior art devices by providing a system and device for identifying characteristics of objects including a plurality of sheets filled with a plurality of columns including a plurality of removable self adhesive labels in each of the number of columns, each label including indicia printed thereon which identifies a particular characteristic associated with an item on which it is adhered. The indicia printed on each label of the system and device for identifying characteristics of objects relates to at least one of a physical quality of the object to which it will be adhered or a monetary value associated of the object to which it will be adhered. Each column of labels is printed in a different color thereby identifying a further characteristic of the object on which it is adhered, the characteristic identified by the color of each label being the owner of the object. Furthermore, the system and device for identifying characteristics of objects of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A system for identifying characteristics of objects, said objects having multiple owners, on which said characteristics are positioned and tracking the identified objects when sold, said system comprising:

a) a master tracking sheet divided into a plurality of subdivisions, each subdivision corresponding with an owner; and b) one or more label sheets, each of said label sheets including a plurality of removable self adhesive labels, each of said plurality of labels coded to correspond with a subdivision on said tracking sheet and containing a piece of information relating to one of said objects including a monetary value for tracking the sale of the objects; and c) each of said subdivisions arranged to accommodate a label containing the price at which a particular object was sold and the labels in a particular subdivision arranged to readily ascertain the total of monetary values received for all objects sold in a given subdivision.

2. The system as recited in claim 1, wherein said means for identifying is indicia printed on a face side of each of said plurality of labels.

3. The system as recited in claim 1, wherein said code is a color code, each group of labels including a different color thereon.

4. The system as recited in claim 3, wherein each subdivision of said master tracking sheet includes a column each column heading being coded with a color code and matched with a respective one of said groups of labels identified by a similar color code.

5. The system as recited in claim 1, wherein at least one of said plurality of labels are adhered to each of the objects.

6. The system as recited in claim 1, wherein more than one of said plurality of labels are adhered to each of the objects.

7. The method of identifying objects having multiple owners and tracking said objects in a sale in which said objects are mingled comprising the steps of:

a) preparing a master tracking sheet in which said various owners are listed with spaces corresponding with said owners;

b) preparing a label sheet, said label sheet including a plurality of removable self adhesive labels, each of said plurality of labels coded for an individual owner and having a piece of information including a sales price and particular characteristics associated with an object on which a label is to be adhered;

c) adhering one or more labels to each of said objects, each said label identifying the owner and also containing a piece of information including the sale price and information describing a characteristic of the object; and d) upon the sale of an object transferring the label containing the price to said master tracking sheet in an area on said master tracking sheet designated for the owner of the sold object, permitting convenient addition of the prices obtained for the objects sold belonging to each of the owners and obtaining a total value for each of said owners after said sale is completed.

* * * * *